US008381949B2

(12) United States Patent
Sunatori

(10) Patent No.: US 8,381,949 B2
(45) Date of Patent: Feb. 26, 2013

(54) MAGNETICALLY-HANGING SPICE DISPENSER WITH A CONTINUOUSLY-VARIABLE HOLE-SIZE SELECTOR

(76) Inventor: Go Simon Sunatori, Gatineau (CA)

( * ) Notice: Subject to any disclaimer, the term of this patent is extended or adjusted under 35 U.S.C. 154(b) by 110 days.

(21) Appl. No.: 13/031,206

(22) Filed: Feb. 19, 2011

(65) Prior Publication Data

US 2012/0138636 A1 Jun. 7, 2012

(51) Int. Cl.
*A47G 19/00* (2006.01)

(52) U.S. Cl. ..... 222/142.3; 211/DIG. 1

(58) Field of Classification Search ..... 222/134.3, 222/142.9, 179.5, 565, 180; 211/74, 76, 211/DIG. 1; 206/818
See application file for complete search history.

(56) References Cited

U.S. PATENT DOCUMENTS 5,368,203 A * 11/1994 Friedrich et al. ..... 222/179.5
7,748,569 B2 * 7/2010 Sunatori ..... 222/142.3
2010/0176157 A1 * 7/2010 Long et al. ..... 222/189.02

* cited by examiner

*Primary Examiner* — Lien Ngo

(57) ABSTRACT

A magnetically-hanging spice dispenser comprises a plate assembly and a container assembly. The plate assembly comprises a non-magnetic planer plate and permanent magnets. The container assembly comprise a cylindrical spice container, a circular removable cap and a magnetic element. Magnetic attraction force between the magnetic element of the container assembly and the permanent magnet of the plate assembly is exerted when the container assembly is placed in proximity to the plate assembly. The container assembly and the plate assembly form self-seal in order to prevent dust, air, moisture and the like from entering into the spice container. The container assembly further comprises a circular elastic cover for covering the removable cap. The elastic cover is capable of variably overlapping with the removable cap so that spices can be dispensed at continuously-variable flow rate. This invention relates to spice dispensers, and the principal use of the invention is for dispensing spices in a kitchen.

15 Claims, 7 Drawing Sheets

MAGNETICALLY-HANGING SPICE DISPENSER WITH A CONTINUOUSLY-VARIABLE HOLE-SIZE SELECTOR

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

This invention relates to spice dispensers, more particularly to a magnetically-hanging spice dispenser.

There are many instances where it would be desirable to be able to save space in a kitchen by magnetically hanging spice containers, and to save time by eliminating the need for opening and closing the spice containers.

A number of patents disclose various kinds of magnetically-hanging spice dispensers.

U.S. Pat. No. 5,368,203 discloses "Spice rack with magnetically held spice containers". The spice container is retained in or on the closure body by a magnetic force which is used to seal the spice container. However, the magnet and the seal are both located on the spice rack, so this prior art spice dispenser accommodates spice containers having only one shape and one size, and the spice container has limited single-row positions for hanging. In addition, the complicated spice rack structure is difficult to clean, if not impossible.

U.S. Pat. No. 7,007,818 discloses "Container assembly". The spice rack assembly includes a rack and at least one container that is magnetically coupled to the rack. Since the magnet attaches to a ferromagnetic plate, this prior art spice dispenser lacks an auto-aligning feature. Also, this prior art spice dispenser does not have a self-sealing feature. Moreover, this prior art spice dispenser requires the users to manually open and close holes after each use.

Canadian Patent 2 349 889 discloses "Magnetically Hanging Spice/Sauce Dispenser System". The hanging spice/sauce dispenser system comprises a planer ferromagnetic plate and a container assembly. This prior art spice dispenser does not have an auto-aligning feature because of the use of a ferromagnetic plate. Furthermore, this prior art spice dispenser lacks a hole-size selector.

These prior art arrangements do not have a magnetically-hanging spice dispenser which has magnetic elements at pre-determined locations for auto-aligning attachment, and has a self-sealing cap for eliminating the need for opening and closing the spice container. None of the prior art spice dispenser has a circular elastic cover which is capable of variably overlapping with the removable cap so that spices can be dispensed at continuously-variable flow rate.

BRIEF SUMMARY OF THE INVENTION

It is a primary object of the invention to provide a magnetically-hanging spice dispenser which has permanent magnets at pre-determined locations for auto-aligning attachment.

It is another object of the invention to provide a magnetically-hanging spice dispenser which has a self-sealing cap for eliminating the need for opening and closing the spice container.

It is another object of the invention to provide a magnetically-hanging spice dispenser which has a spice container that can be attached with one hand, and be detached with one hand.

It is another object of the invention to provide a magnetically-hanging spice dispenser which is easy to clean.

It is another object of the invention to provide a magnetically-hanging spice dispenser which has a rotatable cover capable of selecting continuously-variable hole-size.

It is another object of the invention to provide a magnetically-hanging spice dispenser which has a substantially circular convex protuberance capable of forming a stably closed position and a stably open position.

A magnetically-hanging spice dispenser comprises a plate assembly and a container assembly. The plate assembly comprises a non-magnetic planer plate and permanent magnets. The container assembly comprise a cylindrical spice container, a circular removable cap and a magnetic element. Magnetic attraction force between the magnetic element of the container assembly and the permanent magnet of the plate assembly is exerted when the container assembly is placed in proximity to the plate assembly. The container assembly and the plate assembly form self-seal in order to prevent dust, air, moisture and the like from entering into the spice container. The container assembly further comprises a circular elastic cover for covering the removable cap. The elastic cover is capable of variably overlapping with the removable cap so that spices can be dispensed at continuously-variable flow rate.

BRIEF DESCRIPTION OF THE SEVERAL VIEWS OF THE DRAWING

In drawings which illustrate embodiments of the invention.

DETAILED DESCRIPTION OF THE INVENTION

Figure 1:
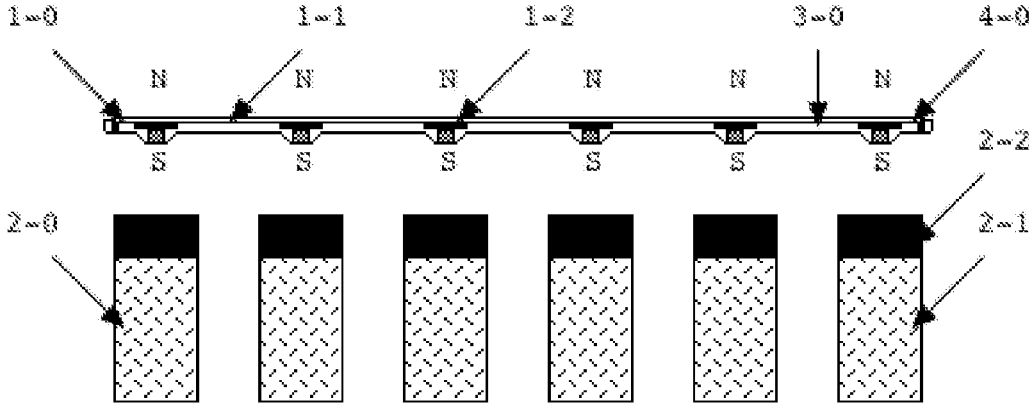
FIG. 1 is a side view of one embodiment of the magnetically-hanging spice dispenser according to the invention.

In one embodiment of the invention shown in FIG. 1 (side view), a magnetically-hanging spice dispenser comprises a plate assembly 1-0 and a container assembly 2-0 for storing spices.

The plate assembly 1-0 has a top surface and a bottom surface. The plate assembly 1-0 comprises a non-magnetic planer plate 1-1 and a plurality of permanent magnets 1-2.

The non-magnetic planer plate 1-1 has a top surface and a bottom surface. The non-magnetic planer plate 1-1 has portions defining a plurality of holes at pre-determined locations. The non-magnetic planer plate 1-1 is capable of being securely mounted horizontally.

Each permanent magnet 1-2 has a top surface and a bottom surface. The permanent magnets 1-2 are securely attached to the holes of the non-magnetic planer plate 1-1.

Figure 2:
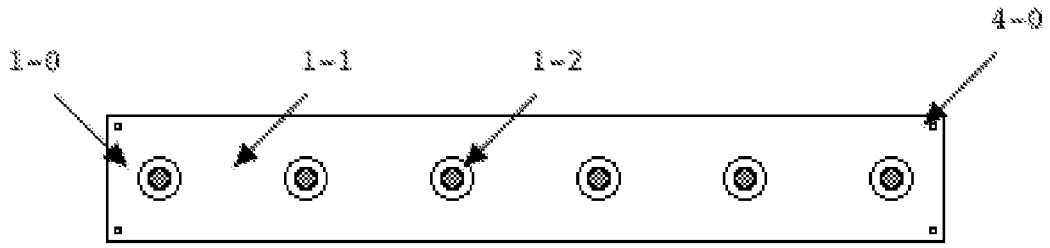
FIG. 2 is a bottom view of the plate assembly.

FIG. 2 (bottom view) shows the plate assembly 1-0 with the non-magnetic planer plate 1-1 and the permanent magnets 1-2.

The container assembly 2-0 comprises a generally cylindrical spice container 2-1, a generally circular removable cap 2-2, and a magnetic element 2-3.

The generally circular removable cap 2-2 has a central portion, a middle portion and a peripheral portion. The generally circular removable cap 2-2 is removably attached to the generally cylindrical spice container 2-1. The middle portion of the generally circular removable cap 2-2 has portions defining a plurality of substantially circular holes for dispensing spices.

The magnetic element 2-3 has a top surface and a bottom surface. The magnetic element 2-3 is securely attached to the generally circular removable cap 2-2.

Figure 3:
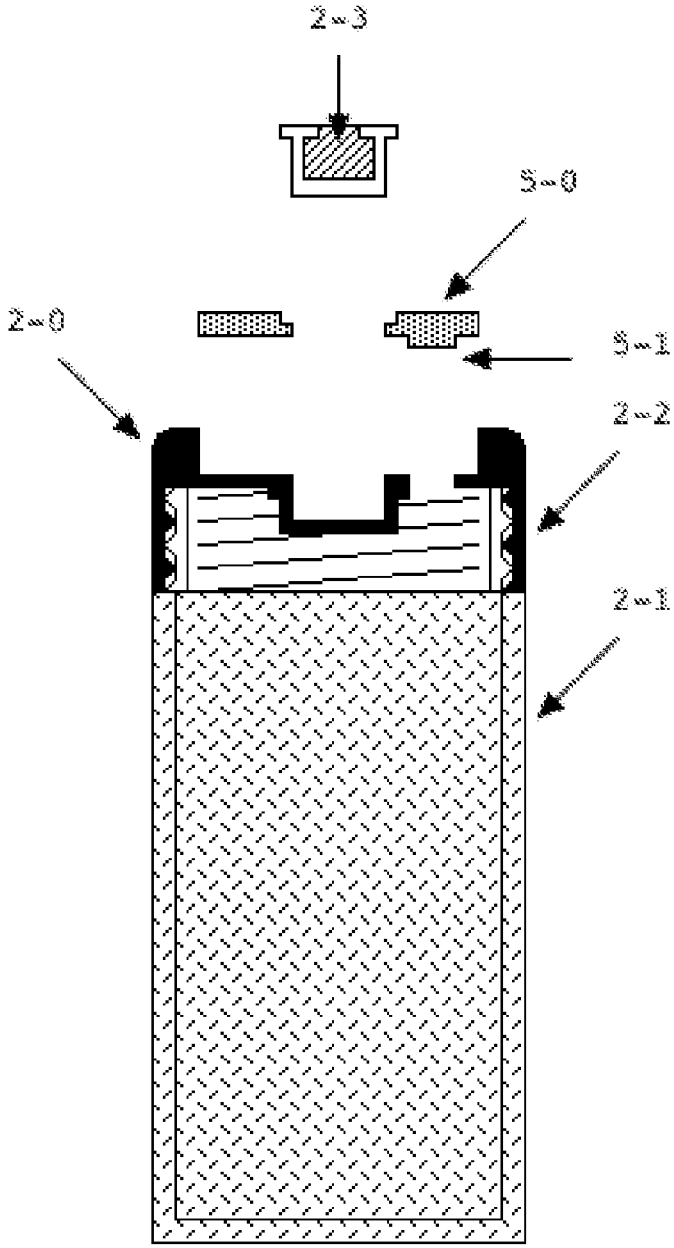
FIG. 3 is an exploded sectional view of the container assembly.

FIG. 3 (sectional view) shows the container assembly 2-0 with the generally cylindrical spice container 2-1, the generally circular removable cap 2-2, and the magnetic element 2-3.

Magnetic attraction force between the magnetic element 2-3 of the container assembly 2-0 and the permanent magnet 1-2 of the plate assembly 1-0 is exerted when the container assembly 2-0 is placed in proximity to the plate assembly 1-0.

The container assembly 2-0 is capable of magnetically attaching to the bottom surface of the plate assembly 1-0.

The container assembly 2-0 is capable of detaching from the bottom surface of the plate assembly 1-0 when force is applied to the container assembly 2-0.

The generally circular removable cap 2-2 of the container assembly 2-0 and the bottom surface of the plate assembly 1-0 form self-seal in order to prevent dust, air, moisture and the like from entering into the generally cylindrical spice container 2-1 when the container assembly 2-0 is magnetically attached to the plate assembly 1-0.

The container assembly 2-0 of the magnetically-hanging spice dispenser may further comprise a generally circular elastic cover 5-0 for covering the middle portion of the generally circular removable cap 2-2 of the container assembly 2-0, as shown in FIG. 3.

The generally circular elastic cover 5-0 is rotatably mounted on the generally circular removable cap 2-2.

The generally circular elastic cover 5-0 has portions defining a plurality of substantially circular holes.

The substantially circular holes of the generally circular elastic cover 5-0 is capable of variably overlapping with the substantially circular holes of the middle portion of the generally circular removable cap 2-2 so that spices can be dispensed at continuously-variable flow rate.

The generally circular elastic cover 5-0 of the container assembly 2-0 of the magnetically-hanging spice dispenser may have portions defining a substantially circular convex protuberance 5-1.

The substantially circular convex protuberance 5-1 has a diameter substantially equal to the diameter of the substantially circular holes of the middle portion of the generally circular removable cap 2-2.

The container assembly 2-0 forms a stably closed position when the substantially circular convex protuberance 5-1 of the generally circular elastic cover 5-0 is positioned inside the substantially circular holes of the middle portion of the generally circular removable cap 2-2.

The container assembly 2-0 forms a stably open position when the substantially circular convex protuberance 5-1 of the generally circular elastic cover 5-0 is positioned outside the substantially circular holes of the middle portion of the generally circular removable cap 2-2.

Figure 4:
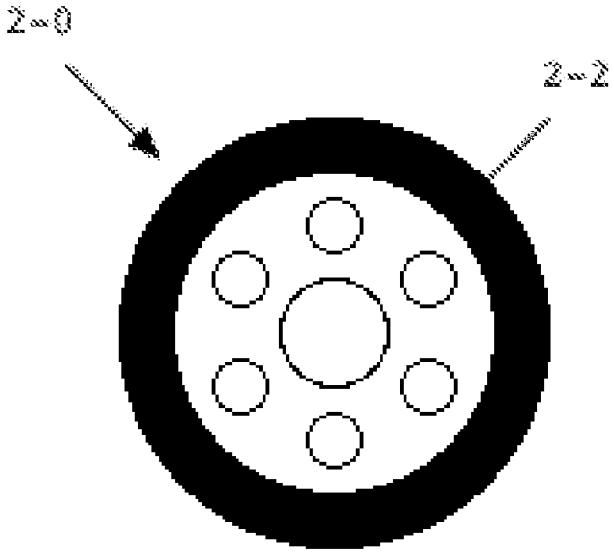
FIG. 4 is a top view of the generally circular removable cap of the container assembly.
Figure 5:
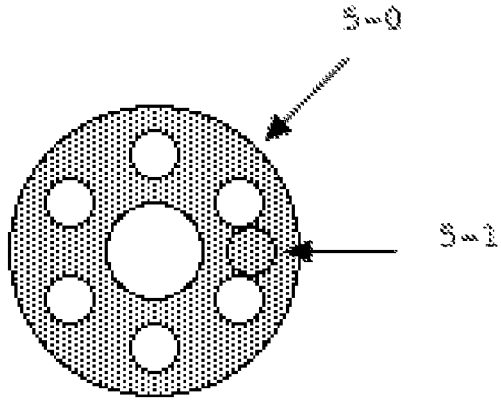
FIG. 5 is a bottom view of the generally circular elastic cover of the container assembly.

FIG. 4 (top view) shows the generally circular removable cap 2-2 of the container assembly 2-0. FIG. 5 (bottom view) shows the generally circular elastic cover 5-0 of the container assembly 5-0 with the substantially circular convex protuberance 5-1.

Figure 6:
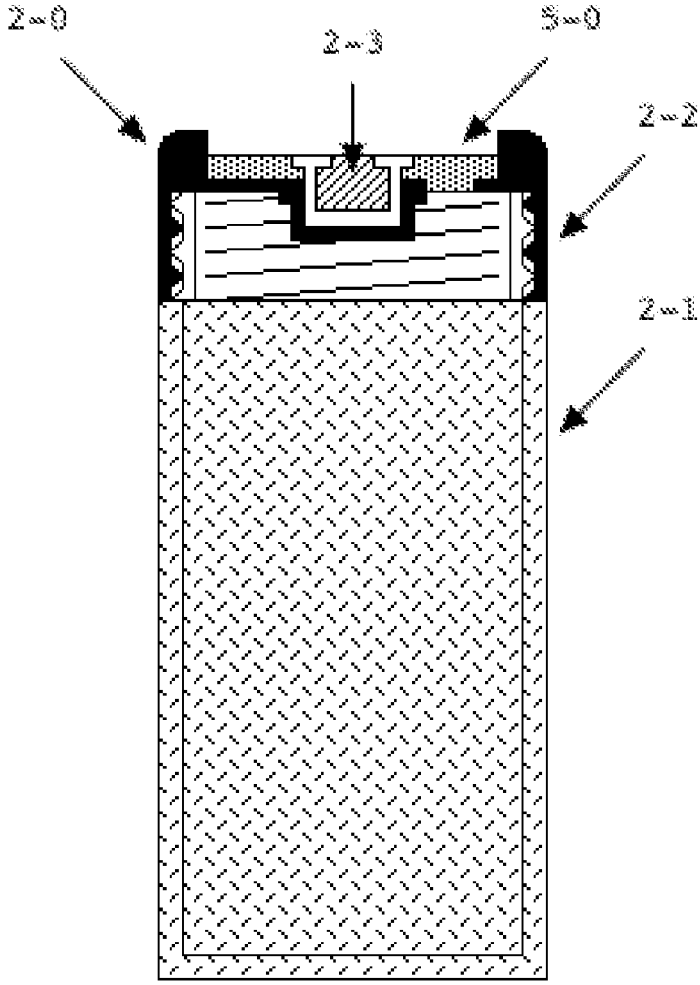
FIG. 6 is a sectional view of the container assembly in a stably closed position.
Figure 7:
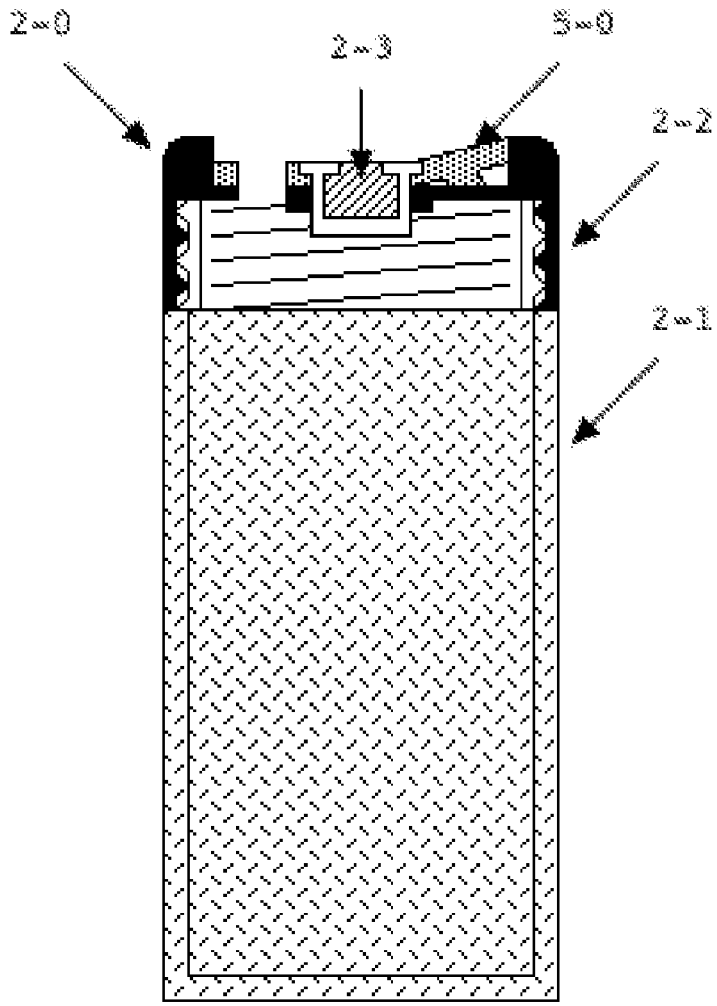
FIG. 7 is a sectional view of the container assembly in a stably open position.

FIG. 6 (sectional view) shows the container assembly 2-0 in a stably closed position. FIG. 7 (sectional view) shows the container assembly 2-0 in a stably open position.

The plate assembly 1-0 of the magnetically-hanging spice dispenser may further comprise an adhesive 3-0 taped on the top surface of the non-magnetic planer plate 1-1 in order to securely attach the plate assembly 1-0 to a horizontal bottom portion of a kitchen cabinet or a shelf.

The non-magnetic planer plate 1-1 of the plate assembly 1-0 of the magnetically-hanging spice dispenser may have portions defining a hole 4-0 for receiving a screw or a nail in order to securely attach the plate assembly 1-0 to a horizontal bottom portion of a kitchen cabinet or a shelf.

Each permanent magnet 1-2 of the plate assembly 1-0 of the magnetically-hanging spice dispenser may be disc-shaped. Alternatively, each permanent magnet 1-2 of the plate assembly 1-0 of the magnetically-hanging spice dispenser may be ring-shaped.

The generally cylindrical spice container 2-1 of the container assembly 2-0 of the magnetically-hanging spice dispenser may be transparent. Alternatively, the generally cylindrical spice container 2-1 of the container assembly 2-0 of the magnetically-hanging spice dispenser may be translucent.

The generally circular removable cap 2-2 of the container assembly 2-0 of the magnetically-hanging spice dispenser may screw into the generally cylindrical spice container 2-1 of the container assembly 2-0. Alternatively, the generally circular removable cap 2-2 of the container assembly 2-0 of the magnetically-hanging spice dispenser may snap into the generally cylindrical spice container 2-1 of the container assembly 2-0.

The magnetic element 2-3 of the container assembly 2-0 of the magnetically-hanging spice dispenser may be embedded in the generally circular removable cap 2-2 of the container assembly 2-0. Alternatively, the top surface of the magnetic element 2-3 of the container assembly 2-0 of the magnetically-hanging spice dispenser may be exposed.

The magnetic element 2-3 of the container assembly 2-0 of the magnetically-hanging spice dispenser may be disc-shaped. Alternatively, the magnetic element 2-3 of the container assembly 2-0 of the magnetically-hanging spice dispenser may be ring-shaped.

The magnetic element 2-3 of the container assembly 2-0 of the magnetically-hanging spice dispenser may be made of a permanent magnet. Alternatively, the magnetic element 2-3 of the container assembly 2-0 of the magnetically-hanging spice dispenser may be made of a ferromagnetic material.

Preferably, the permanent magnets are made of rare-earth magnets.

What is claimed is:

1. A magnetically-hanging spice dispenser comprising:

a plate assembly having a top surface and a bottom surface, the plate assembly comprising:

a non-magnetic planer plate having a top surface and a bottom surface, the non-magnetic planer plate having portions defining a plurality of holes at pre-determined locations, the non-magnetic planer plate capable of being securely mounted horizontally; and a plurality of permanent magnets, each permanent magnet having a top surface and a bottom surface, the permanent magnets securely attached to the holes of the non-magnetic planer plate; and a container assembly for storing spices, the container assembly comprising:

a generally cylindrical spice container;

a generally circular removable cap having a central portion, a middle portion and a peripheral portion, the generally circular removable cap removably attached to the generally cylindrical spice container, the middle portion of the generally circular removable cap having portions defining a plurality of substantially circular holes for dispensing spices;

a magnetic element having a top surface and a bottom surface, the magnetic element securely attached to the generally circular removable cap; and a generally circular elastic cover for covering the middle portion of the generally circular removable cap of the container assembly, the generally circular elastic cover rotatably mounted on the generally circular removable cap, the generally circular elastic cover having portions defining a plurality of substantially circular holes, the substantially circular holes of the generally circular elastic cover capable of variably overlapping with the substantially circular holes of the middle portion of the generally circular removable cap so that spices can be dispensed at continuously-variable flow rate, the generally circular elastic cover having a portion defining a substantially circular convex protuberance, the substantially circular convex protuberance having a diameter substantially equal to the diameter of the substantially circular hole of the middle portion of the generally circular removable cap.

2. The magnetically-hanging spice dispenser as defined in claim 1, in which the plate assembly further comprises:

an adhesive taped on the top surface of the non-magnetic planer plate in order to securely attach the plate assembly to a horizontal bottom portion of a kitchen cabinet or a shelf.

3. The magnetically-hanging spice dispenser as defined in claim 1, in which the non-magnetic planer plate of the plate assembly has portions defining a hole for receiving a screw or a nail in order to securely attach the plate assembly to a horizontal bottom portion of a kitchen cabinet or a shelf.

4. The magnetically-hanging spice dispenser as defined in claim 1, in which each permanent magnet of the plate assembly is disc-shaped.

5. The magnetically-hanging spice dispenser as defined in claim 1, in which each permanent magnet of the plate assembly is ring-shaped.

6. The magnetically-hanging spice dispenser as defined in claim 1, in which the generally cylindrical spice container of the container assembly is transparent.

7. The magnetically-hanging spice dispenser as defined in claim 1, in which the generally cylindrical spice container of the container assembly is translucent.

8. The magnetically-hanging spice dispenser as defined in claim 1, in which the generally circular removable cap of the container assembly screws into the generally cylindrical spice container of the container assembly.

9. The magnetically-hanging spice dispenser as defined in claim 1, in which the generally circular removable cap of the container assembly snaps into the generally cylindrical spice container of the container assembly.

10. The magnetically-hanging spice dispenser as defined in claim 1, in which the magnetic element of the container assembly is embedded in the generally circular removable cap of the container assembly.

11. The magnetically-hanging spice dispenser as defined in claim 1, in which the top surface of the magnetic element of the container assembly is exposed.

12. The magnetically-hanging spice dispenser as defined in claim 1, in which the magnetic element of the container assembly is disc-shaped.

13. The magnetically-hanging spice dispenser as defined in claim 1, in which the magnetic element of the container assembly is ring-shaped.

14. The magnetically-hanging spice dispenser as defined in claim 1, in which the magnetic element of the container assembly is made of a permanent magnet.

15. The magnetically-hanging spice dispenser as defined in claim 1, in which the magnetic element of the container assembly is made of a ferromagnetic material.

* * * * *